US007779822B2

(12) United States Patent
Prior et al.

(10) Patent No.: US 7,779,822 B2
(45) Date of Patent: Aug. 24, 2010

(54) INTAKE ASSEMBLY WITH INTEGRAL RESONATORS

(75) Inventors: Gregory P. Prior, Birmingham, MI (US); Roxanne M. Bittner, Royal Oak, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 131 days.

(21) Appl. No.: 11/622,481

(22) Filed: Jan. 12, 2007

(65) Prior Publication Data

US 2008/0168961 A1 Jul. 17, 2008

(51) Int. Cl.

| | |
|---|---|
| ***F02B 33/00*** | (2006.01) |
| ***F02B 33/44*** | (2006.01) |
| ***F02B 29/04*** | (2006.01) |
| ***F04C 18/16*** | (2006.01) |
| ***F04C 18/00*** | (2006.01) |
| ***F04C 2/00*** | (2006.01) |
| ***F02M 35/10*** | (2006.01) |
| ***F01N 1/18*** | (2006.01) |
| ***F01N 1/02*** | (2006.01) |
| ***F01N 1/08*** | (2006.01) |

(52) U.S. Cl. ..... 123/559.1; 123/184.57; 123/184.42; 123/184.47; 418/201.1; 418/201.3; 418/206.1; 418/206.4; 181/241; 181/250

(58) Field of Classification Search ..... 123/559.1, 123/184.42, 184.57, 184.47; 418/206.1, 418/206.4, 205, 201.3, 201.1; 181/250
See application file for complete search history.

(56) References Cited

U.S. PATENT DOCUMENTS

| | | | | |
|---|---|---|---|---|
| 1,811,250 | A * | 6/1931 | Balduf | 52/402 |
| 2,287,716 | A * | 6/1942 | Whitfield | 418/201.1 |
| 2,620,124 | A * | 12/1952 | Brill et al. | 418/83 |
| 2,705,541 | A * | 4/1955 | Finch | 181/243 |
| 3,283,996 | A * | 11/1966 | Schibbye | 418/201.3 |
| 4,548,558 | A * | 10/1985 | Sakamaki et al. | 418/83 |
| 4,725,334 | A * | 2/1988 | Brimm | 216/34 |
| 4,768,934 | A * | 9/1988 | Soeters, Jr. | 418/201.1 |
| 4,828,467 | A * | 5/1989 | Brown | 418/201.1 |
| 5,596,870 | A * | 1/1997 | Dillard et al. | 60/782 |
| 5,979,598 | A | 11/1999 | Wolf et al. | 181/272 |
| 6,073,517 | A * | 6/2000 | Pauwels et al. | 123/195 R |
| 6,589,034 | B2 * | 7/2003 | Vorwerk et al. | 418/206.4 |
| 6,758,661 | B1 * | 7/2004 | Thelen | 418/206.1 |

(Continued)

FOREIGN PATENT DOCUMENTS

DE 3531353 A1 * 3/1987

(Continued)

*Primary Examiner*—Thai Ba Trieu
(74) *Attorney, Agent, or Firm*—Quinn Law Group, PLLC

(57) ABSTRACT

An intake assembly, such as a supercharger assembly, is provided for an internal combustion engine. The intake assembly includes a housing having a wall defining an inlet passage through which intake air enters the intake assembly. A plurality of stiffening ribs is provided on the wall opposite the inlet passage and at least partially defines at least one cavity. A plate is mounted to the wall of the housing and further defines the at least one cavity. The wall defines at least one orifice configured to provide communication between the inlet passage and the at least one cavity. The at least one cavity and the at least one orifice cooperate to form at least one resonator. A method of forming the intake assembly having integral resonators is also provided.

9 Claims, 2 Drawing Sheets

U.S. PATENT DOCUMENTS

| | | | | |
|---|---|---|---|---|
| 7,497,196 | B2 * | 3/2009 | Prior | 123/184.57 |
| 7,584,821 | B2 * | 9/2009 | Prior et al. | 181/241 |
| 2002/0020382 | A1 * | 2/2002 | Leipelt et al. | 123/184.42 |
| 2005/0150718 | A1 * | 7/2005 | Knight et al. | 181/250 |
| 2006/0027204 | A1 | 2/2006 | Vogt | 123/184.57 |
| 2007/0107704 | A1 * | 5/2007 | Billings et al. | 123/559.1 |
| 2008/0060622 | A1 * | 3/2008 | Prior | 123/559.1 |

FOREIGN PATENT DOCUMENTS

| | | | | |
|---|---|---|---|---|
| GB | 2424450 | A | * | 9/2006 |
| JP | 01313686 | A | * | 12/1989 |
| WO | WO 2006111307 | A1 | * | 10/2006 |

* cited by examiner

INTAKE ASSEMBLY WITH INTEGRAL RESONATORS

TECHNICAL FIELD

The present invention relates to an intake assembly incorporating a supercharger having integral resonators formed on an inlet side of a supercharger housing.

BACKGROUND OF THE INVENTION

Various methods may be employed to reduce the intake noise of an internal combustion engine. One method is to use a Helmholtz resonator on an intake air pipe configured to communicate intake air to the internal combustion engine. The intake air pipe is typically disposed upstream from an intake manifold and is configured to communicate intake air to the intake manifold of the internal combustion engine. A Helmholtz resonator includes a resonance volume or chamber having a small opening, typically referred to as a neck. The neck is operable to enable communication between the resonance chamber and the intake air pipe. Sound waves generated by components within the internal combustion engine travel along the intake air pipe where their acoustic pressure impinges on the neck. This acoustic pressure excites a mass of air within the neck. The acoustic pressure within the resonance chamber reacts against the air mass within the neck and produces an out-of-phase acoustic pressure at the intake air pipe to cause cancellation of intake noise at the resonant frequency. In this way, some of the engine noise is eliminated as the out-of-phase acoustic pressures in the intake air pipe cancel each other.

The frequency at which the attenuating acoustic pressures reach their maximum amplitude is known as the resonant frequency. A number of parameters determine the resonant frequency and bandwidth of a Helmholtz resonator, including the volume of the resonance chamber and the length and cross sectional area of the neck.

SUMMARY OF THE INVENTION

An intake assembly, such as a supercharger assembly, is provided for an internal combustion engine. The intake assembly includes a housing having a wall defining an inlet passage through which intake air enters the intake assembly. A plurality of stiffening ribs are provided on the wall opposite the inlet passage and at least partially define at least one cavity. A plate is mounted to the wall of the housing and further defines the at least one cavity. The wall defines at least one orifice configured to provide communication between the inlet passage and the at least one cavity. The at least one cavity and the at least one orifice cooperate to form at least one resonator. Preferably, the plate is sealingly engaged with the wall of the housing, such as by a gasket member, sealant, etc.

A method of forming integral resonators within the intake assembly is also provided including the steps of. A) forming the orifices in the housing operable to provide communication between the inlet passage and the cavities; and B) mounting the plate to the housing to further define the cavities. As mentioned hereinabove, the orifices and the cavities cooperate to form the resonator. The method further includes the step of sealing the plate with respect to the housing.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
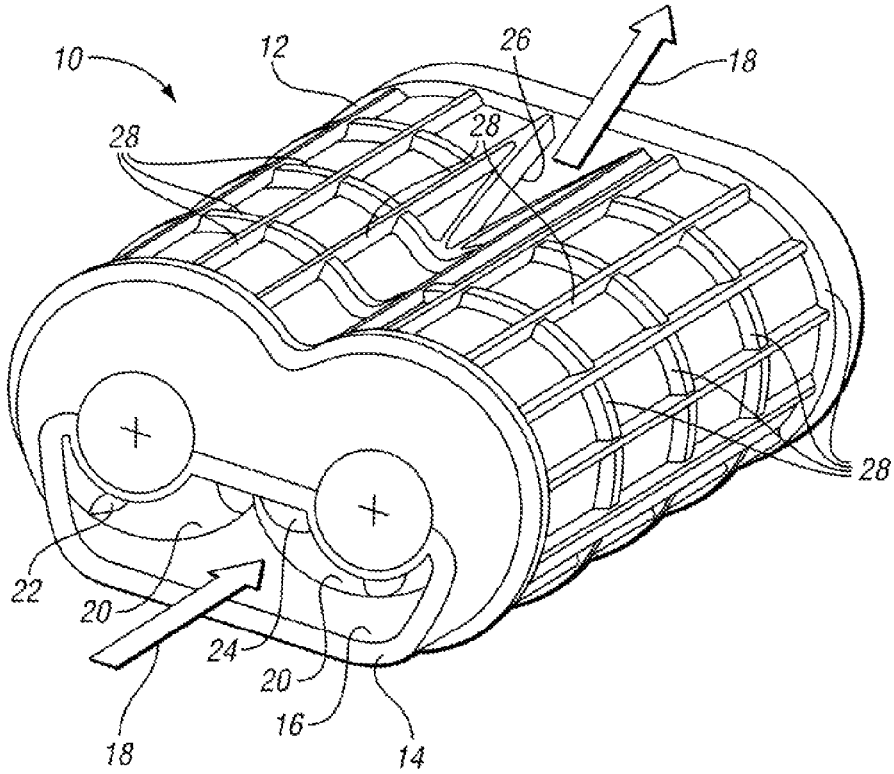
FIG. 1 is a perspective view of an intake assembly or supercharger assembly.

Referring to the drawings wherein like reference numbers correspond to like or similar components throughout the several figures, there is shown in FIG. 1 a perspective view of an intake assembly or supercharger 10 for an internal combustion engine, not shown. Although the intake assembly is illustrated in FIG. 1 as a supercharger 10; those skilled in the art will recognize that the intake assembly may have other forms, such as an intake manifold, while remaining within the scope of that which is claimed. The supercharger assembly 10, as shown in FIG. 1, is a roots-type or screw-type supercharger and includes a housing 12 having a wall 14 that at least partially defines an inlet passage 16. The inlet passage 16 is configured to communicate intake air, indicted by arrow 18, into the supercharger assembly 10. The housing 12 further defines a rotor cavity 20 within which a first and second rotor 22 and 24, respectively are rotatably contained. The first and second rotors 22 and 24 are counter-rotating with respect to each other and cooperate to transfer volumes of intake air 18 as it passes through the rotor cavity 20 to an exit port 26 defined by the housing 12 where it is subsequently introduced to the internal combustion engine, not shown.

Figure 2:
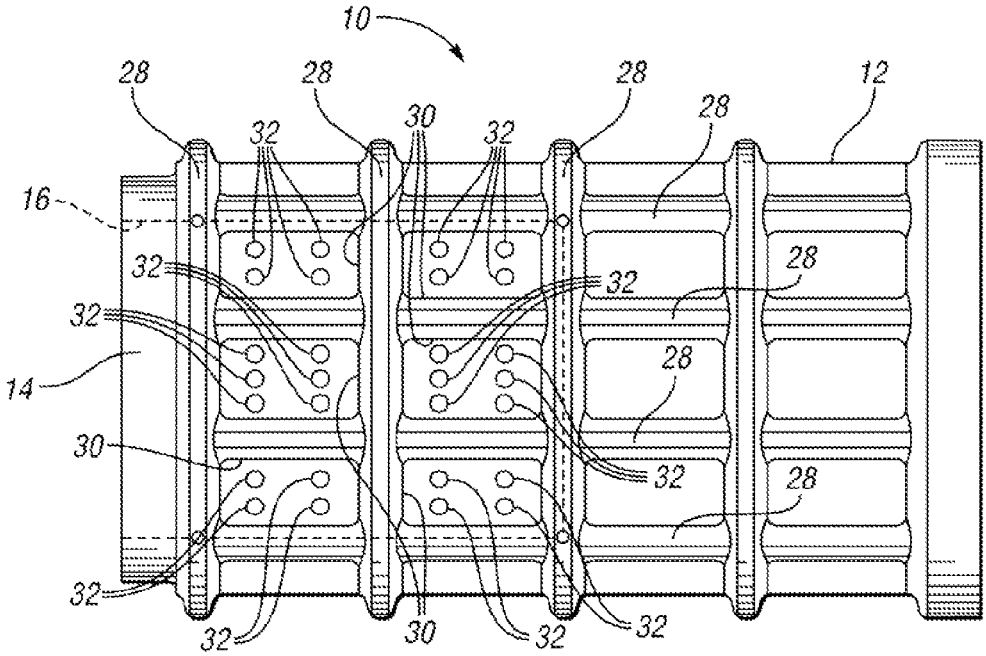
FIG. 2 is a bottom view of the supercharger assembly of FIG. 1 illustrating stiffening ribs provided on a housing and partially defining a plurality of cavities or volumes.
Figure 3:
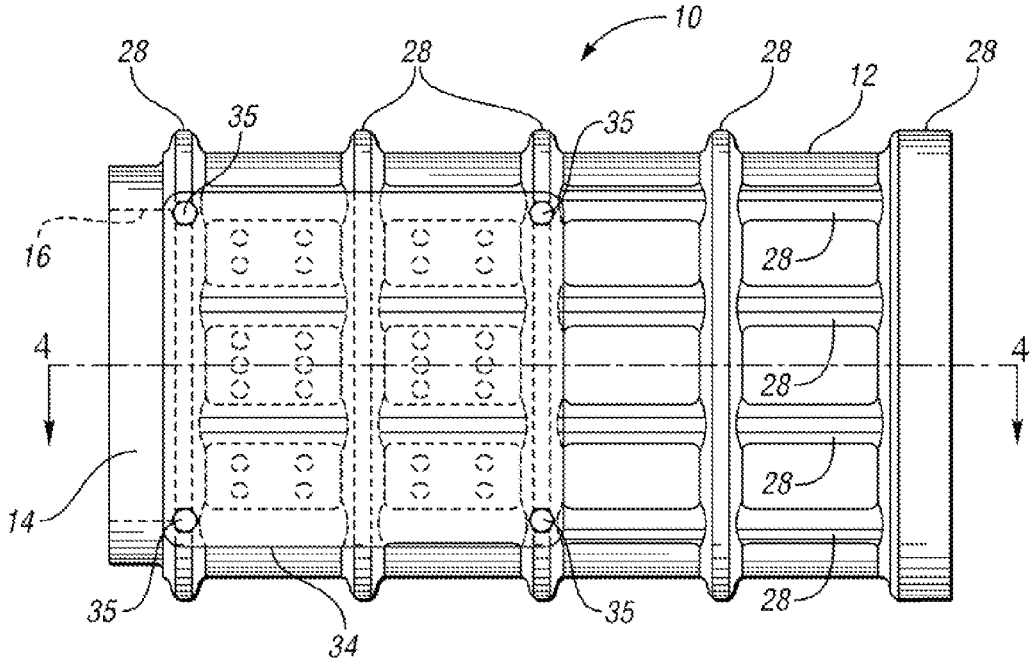
FIG. 3 is a bottom view of the supercharger assembly of FIGS. 1 and 2 illustrating a plate mounted to the housing and further defining the plurality of volumes.
Figure 4:
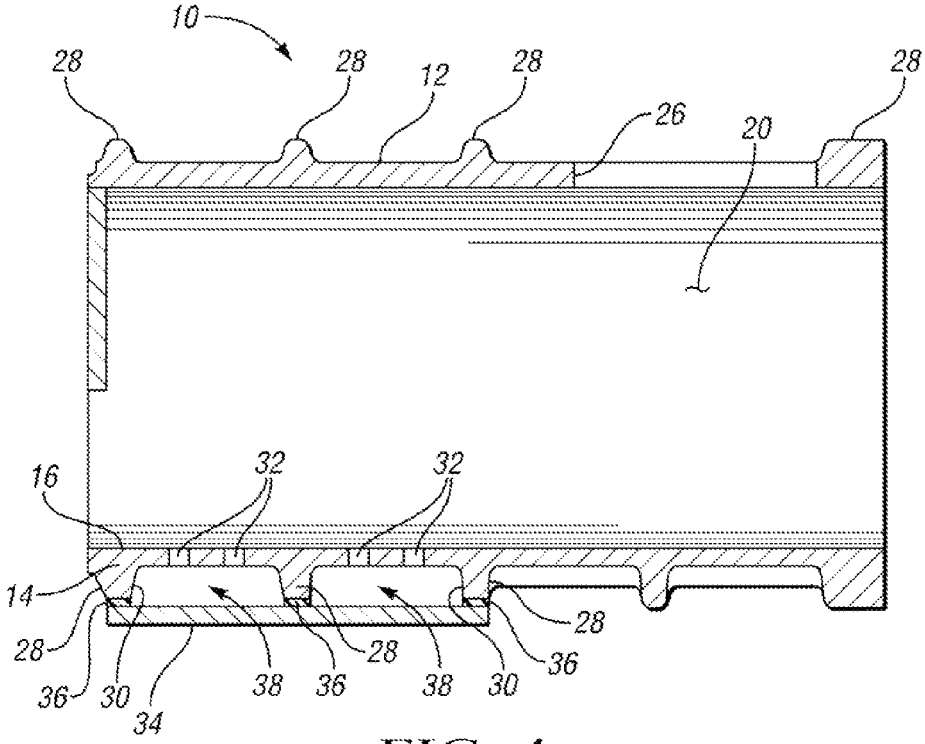
FIG. 4 is a cross sectional view of the supercharger assembly of FIG. 3, taken along line 4-4, illustrating integral resonators.

A plurality of stiffening ribs 28 are provided on the housing 12 to prevent distortion of the housing 12 during operation of the supercharger assembly 10. The stiffening ribs 28 are preferably arranged in a generally cross-wise arrangement to form a waffle pattern. Referring now to FIG. 2, there is shown a bottom view of the supercharger assembly 10. The stiffening ribs 28 cooperate to partially define a plurality of cavities or volumes 30 on the side of the wall 14 opposite the inlet passage 16. A plurality of orifices 32 are defined by the wall 14 and are configured to allow communication between the cavities 30 and the inlet passage 16. Referring to FIG. 3, there is shown a bottom view of the intake assembly 12 having a plate 34 mounted to the housing 12 by a plurality of fasteners 35. Referring now to FIG. 4, there is shown a cross sectional view of the housing 12 taken along line 4-4 of FIG. 3. The plate 34 further defines the cavities 30. The plate 34 is sealed with respect to the housing by a gasket member 36. Alternately, a sealant, such a room temperature vulcanizing (RTV) sealant, may be used in lieu of the gasket member 36. Since a vacuum is typically present within the inlet passage 16 during operation of the supercharger assembly 10, it is beneficial to seal the plate 34 to prevent the unwanted entry of air into the cavities 30 and the inlet passage 16. The plate 34 is preferably formed from a material possessing sufficient structural rigidity to avoid deflection. Additionally, the plate 34 may further tend to increase the rigidity of the wall 14 of the housing 12.

As illustrated in FIG. 4, the cavities 30 and orifices 32 cooperate to form resonators 38, such as a Helmholtz resonator. The cavities 30 form resonance chambers, while the orifices 32 form necks. The frequency at which the resonators 38 attenuate may be varied by varying the volume of the cavities 30 and/or the volume of the orifices 32. Multiple frequencies may be attenuated by providing cavities 30 and orifices 32 of varying dimensions or geometries. Additionally, multiple orifices 32 may be provided in communication with each of the cavities 30, as shown in FIG. 4. The resonator 38 may also be provided with orifices 32 and cavities 30 having a constant cross sectional area such that the resonator 38 forms a quarter wave resonator.

By positioning the resonators 38 near the noise source, i.e. the supercharger assembly 10, the pressure pulses acting on the housing 12 may be reduced resulting in less radiation of noise than with noise attenuation devices mounted further upstream of the inlet passage 16 of the supercharger assembly 10. Additionally, the flow of intake air 18 through the intake passage 16 may improve by employing the resonators 38 as a result of the cancellation of pressure pulses within the inlet passage 16 of the supercharger assembly 10.

A method of forming integral resonators 38 within the supercharger assembly 10 is also provided including the steps of: A) forming the orifices 32 in the housing 12 operable to provide communication between the inlet passage 16 and the cavities 30; and B) mounting the plate 34 to the housing 12 to further define the cavities. As mentioned hereinabove the orifices 32 and the cavities 30 cooperate to form the resonator 38. The method further includes the step of sealing the plate 34 with respect to the housing 12. The orifices 32 may be formed by machining the housing 12 such as by drilling or reaming. Alternately, if the housing 12 is a cast component, the orifices 32 may be formed by pin-like mold features, not shown, disposed within a mold, not shown, and used to form the housing 12. The pin-like mold features may form closed ended bores, such that the orifices 32 are formed by the removal of material from the resulting closed ended bores during the machining of the inlet passage 16.

While the best modes for carrying out the invention have been described in detail, those familiar with the art to which this invention relates will recognize various alternative designs and embodiments for practicing the invention within the scope of the appended claims.

The invention claimed is:

1. A method of forming at least one resonator within an intake assembly including a housing having a wall with a plurality of stiffening ribs formed thereon, wherein the plurality of stiffening ribs on the wall of the housing are arranged in a generally cross-wise arrangement to form a waffle pattern, wherein the plurality of stiffening ribs on the wall of the housing partially define at least one cavity on the wall opposite an inlet passage defined by the housing through which intake air passes, the method comprising:

forming at least one orifice in the housing, wherein said orifice is operable to provide communication between the inlet passage and the at least one cavity;

mounting a generally flat plate to the plurality of stiffening ribs to further define the at least one cavity;

forming at least one resonator with cooperation of the at least one orifice and the at least one cavity; and sealing said generally flat plate to the housing.

2. The method of claim 1, wherein the housing is formed by a casting operation and wherein forming said at least one orifice is performed by at least one of a machining operation and said casting operation.

3. The method of claim 1, wherein the intake assembly is a supercharger assembly and wherein the housing defines a rotor cavity, said supercharger assembly having a plurality of counter-rotating rotors disposed within said rotor cavity.

4. An intake assembly for an internal combustion engine comprising:

a housing having a wall defining an inlet passage through which intake air enters the intake assembly;

a plurality of stiffening ribs provided on said wall opposite said inlet passage and at least partially defining at least one cavity, wherein said plurality of stiffening ribs are arranged generally cross-wise in a waffle pattern;

a generally flat plate mounted to said plurality of stiffening ribs and further defining said at least one cavity;

wherein said wall defines at least one orifice configured to provide communication between said inlet passage and said at least one cavity; and wherein said at least one cavity and said at least one orifice cooperate to form at least one resonator; and wherein said plate is configured to sealingly engage said wall of said housing.

5. The intake assembly of claim 4, wherein the intake assembly is a supercharger and wherein said housing defines a rotor cavity, said supercharger assembly having a plurality of counter-rotating rotors disposed within said rotor cavity.

6. The intake assembly of claim 4, further comprising a gasket member disposed between said plate and said housing and operable to seal said generally flat plate with respect to said housing.

7. The intake assembly of claim 4, wherein said at least one cavity is a plurality of cavities each of which has constant cross-sectional area such that the at least one resonator is a quarter wave resonator.

8. A supercharger assembly for an internal combustion engine comprising:

a housing having a wall defining an inlet passage through which intake air enters the supercharger assembly a plurality of stiffening ribs provided on said wall opposite said inlet passage and at least partially defining at least one cavity, wherein said plurality of stiffening ribs are arranged generally cross-wise in a waffle pattern;

a rotor cavity defined by said housing and sufficiently configured to contain a plurality of counter rotating rotors operable to pressurized said intake air;

a generally flat plate mounted to said plurality of stiffening ribs and further defining said at least one cavity;

wherein said wall defines at least one orifice configured to provide communication between said inlet passage and said at least one cavity; and wherein said at least one cavity and said at least one orifice cooperate to form at least one resonator; and wherein said plate is configured to sealingly engage said wall of said housing.

9. The supercharger assembly of claim 8, further comprising a gasket member disposed between said plate and said housing and operable to seal said generally flat plate with respect to said housing.

* * * * *